United States Patent [19]

Barton

[11] 4,280,440

[45] Jul. 28, 1981

[54] BOAT MOORING APPARATUS

[76] Inventor: James I. Barton, 7505 Caminito Avola, La Jolla, Calif. 92037

[21] Appl. No.: 17,435

[22] Filed: Mar. 5, 1979

[51] Int. Cl.[3] ..... B63B 21/00

[52] U.S. Cl. ..... 114/230; 114/219; 405/212

[58] Field of Search ..... 405/212, 214; 52/697; 248/124, 282; 114/219, 230, 231, 220

[56] References Cited

U.S. PATENT DOCUMENTS

| | | | |
|---|---|---|---|
| 3,120,831 | 2/1964 | Fulton | 114/230 |
| 3,151,595 | 10/1964 | Stainbrook | 114/230 |
| 3,183,875 | 5/1965 | Russell | 114/219 |
| 3,183,877 | 5/1965 | Benzel | 114/230 |
| 3,195,498 | 7/1965 | Johns | 114/230 |
| 3,307,514 | 3/1967 | Young | 114/230 |
| 3,373,714 | 3/1968 | Hart | 114/230 |
| 3,763,816 | 10/1973 | Wilson | 114/230 |
| 4,055,136 | 10/1977 | Fujisawa | 114/219 |

*Primary Examiner*—Trygve M. Blix
*Assistant Examiner*—D. W. Keen
*Attorney, Agent, or Firm*—Ellsworth R. Roston; Charles H. Schwartz

[57] ABSTRACT

A mooring arrangement for a boat includes resilient apparatus formed from a plurality of members which may be disposed telescopically in detachable relationship to one another. The resilient apparatus may be detachably secured by attachment apparatus on the dock for pivotable disposition relative to the attachment apparatus.

A first cord is secured at one end of the dock by attachment apparatus. At a displaced position, the cord is detachably engaged by first securing apparatus on the resilient means. A second cord is also secured at one end by attachment apparatus on the dock and is attached at a displaced position to bumper apparatus. The second cord is adapted to be detachably retained by second securing apparatus on the resilient apparatus so that the bumper apparatus hangs downwardly from the resilient apparatus and biases the resilient apparatus downwardly.

Engaging apparatus may extend outwardly from the resilient apparatus to a position over the water in the slip in the operative disposition of the arrangement. The engaging apparatus may be pivotable, when not in use, from a horizontal disposition to a vertical disposition substantially conforming with the resilient apparatus.

14 Claims, 6 Drawing Figures

BOAT MOORING APPARATUS

This invention relates to arrangements for mooring boats in dock slips. The invention particularly relates to arrangements for providing safe, easy and efficient mooring of boats in dock slips even while the boat is moving into the dock slip. The invention is especially advantageous because it provides for a safe, easy and efficient mooring of boats in dock slips by sailors in the boats.

In recent years, considerable advances have been made in the construction and appearance of boats. With these advances, boats are now sleek and efficient. However, in spite of such advances, the apparatus for, and techniques of, mooring boats in dock slips is still as crude as ever. For example, it is difficult for sailors on a boat, and particularly a pleasure boat, to moor the boat as the boat moves into the dock slip. Generally, the sailors have had to jump from the boat to the dock, as the boat moves into the dock, to moor the boat to the dock. This has been dangerous, particularly for elderly sailors on pleasure boats, because many sailors are not spry. The problems have been compounded because the boats have been moving into the dock and the boat has been pitching during such movement as a result of the waves in the water. The problems have been even further aggrevated because the decks of the boats have been raised to allow sailors to walk below deck without bending. This has caused the boat deck to be disposed above the dock so that the difficulty of sailors in moving from the boat to the dock has been compounded.

Considerable effort has been made to provide apparatus which overcomes the disadvantages discussed in the previous paragraph. Such efforts have been far from successful. In spite of such efforts, the same problems still exist as have existed in previous years. Specifically, it has been difficult for occupants of a boat to moor a boat during movement of the boat into a slip, without having to leave the boat during such mooring operation or requiring help of individuals on the dock if any are there.

In one embodiment of the invention, a mooring arrangement for a boat includes resilient means which may be formed from a plurality of members. The members may be disposed telescopically in detachable relationship to one another. The resilient means may be detachably secured by attachment means on the dock for pivotable disposition relative to the attachment means.

A first cord is secured at one end to the dock by attachment means. At a displaced position, the first cord is detachably engaged by first securing means on the resilient means. A second cord is secured at a first end by attachment means on the dock and is attached at the other end to bumper means. The second cord is adapted to be detachably retained by securing means on the resilient means at a position displaced from the first end.

Engaging means may extend outwardly from the resilient means to a position over the water in the slip in the operative disposition of the arrangement. The engaging means may be pivotable by the boat during the movement of the boat into the dock slip. The resilient means may be pivotable, when not in use, from a horizontal disposition to a vertical disposition substantially conforming with the resilient means.

During movement of a boat into the slip, the boat engages the engaging means to pivot the engaging means and the resilient means. Since the resilient means is biased downwardly by the weight of the bumper means on the resilient means, the pivotal movement of the resilient means causes the first and second cords to become positioned for manual engagement by the sailor on the boat. The first cord is then disengaged from the resilient means and is tied to the boat to moor the boat in the dock. The second cord is disengaged from the resilient means and is tied at an intermediate position to the boat. The bumper is then disposed over the water between the hull of the boat and the dock to prevent the boat from scraping against the side of the dock slip.

Figure 3:
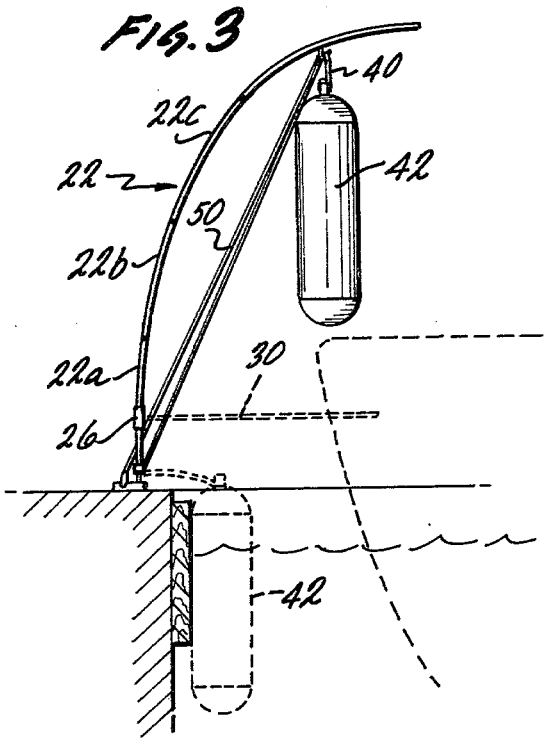
FIG. 3 is an enlarged front elevational view of the arrangement of this invention as seen from a position similar to that shown in FIG. 1.
Figure 4:
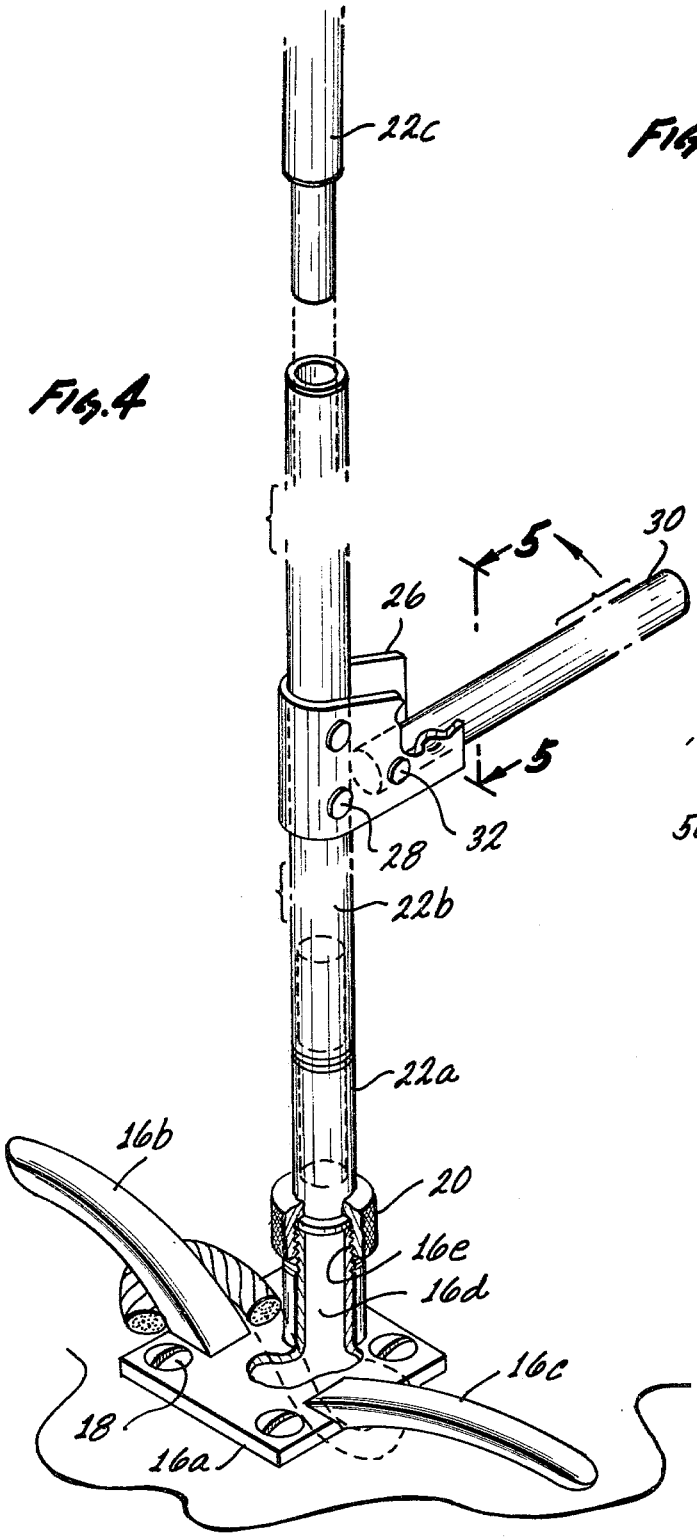
FIG. 4 is an enlarged fragmentary perspective view, partially exploded, of the base portion of the arrangement constituting this invention.
Figure 5:
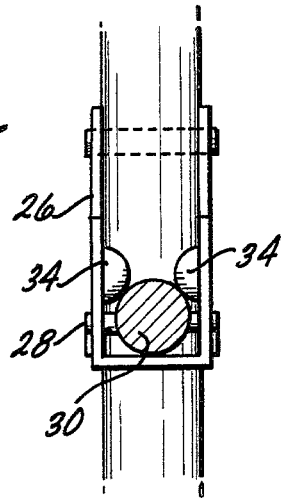
Figure 6:
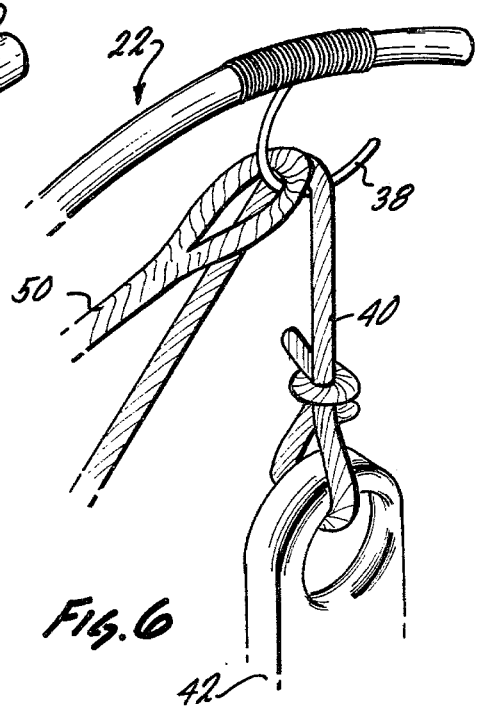

FIG. 5 is an enlarged sectional view substantially on the line 5—5 of FIG. 4 and illustrates the construction of engaging means for operation by the boat as the boat enters the dock slip; and FIG. 6 is an enlarged fragmentary perspective view of a portion of the arrangement shown in FIGS. 1 through 4, this portion of the arrangement being used to facilitate the attachment to the boat of a cord moored to the dock.

In one embodiment of the invention, an arrangement is provided for facilitating the mooring of a boat 10 in a slip generally indicated at 12 of a dock generally indicated at 14. Attachment means such as a mooring post 16 of a conventional construction is disposed on the dock. The mooring post may be provided with a platform portion **16*a* (FIG. 4) and a pair of support arms 16*b* and 16*c* extending upwardly and outwardly in opposite directions from the platform portion 16*a*. The platform portion 16*a* is attached as by screws 18 to the dock 14**.

A collar portion **16*d* extends upwardly from the platform portion 16*a* in integral relationship with the platform portion at a position between the support arms 16*b* and 16*c*. The collar portion 16*d* may be threaded as at 16*e*. An internally threaded sleeve 20 may be mounted on the collar portion 16*d***. If desired, such mounting may be loose but permanent.

Resilient means such as a resilient rod generally indicated at 22 is secured by the attachment means such as the mooring post 16. The resilient rod may be formed from a plurality of members **22*a*, 22*b*, 22*c*, etc. removably attached to each other in a telescopic relationship. The members 22*a*, 22*b*, 22*c*, etc. have pliant properties so that they will bend under weight. In this sense, the members 22*a*, 22*b*, 22*c*, etc. are associated with one another in a manner corresponding to the telescoping members in a fishing rod. If desired, the member 22*a* may be externally threaded so that it can be screwed into the collar portion 16*d* and the sleeve 20**.

A yoke 26 extends around the rod 22 at a relatively low position along the vertical length of the rod. The yoke may be attached to the rod 22 as by screws or rivets 28. Engaging means such as a bar 30 is disposed between the arms of the yoke 26 and is pivotably attached to the arms of the yoke as by rivets or screws 32 for pivotable movement between a horizontal position as shown in FIG. 4 and a vertical position in juxtaposition to the member 22. The bar 30 may be retained in the horizontal position by detent member 34 on the interior surfaces of the arms of the yoke 26 so that the bar has to be forcibly lifted to the vertical position.

A hook member 38 is attached to the resilient rod 22 at a position above the bar 30 but intermediate along the vertical height of the rod. The hook member 38 is disposed at a position removed angularly by an angle of approximately 90° from the bar 30. The hook member 38 is adapted to receive an eye spline on flexible securing means such as a rope or cord 40. A bumper member of fender 42 is attached to the cord 40 to hang downwardly from the position of the eye spline. The cord 40 is attached at one end to the support arms **16*b* and 16*c***.

The position of the hook member 38 may be adjustable along the length of the rod 22 to compensate for differences in the weight of the bumper member 42. In this way, the bumper member or fender 42 is effective in bending the cord of the rod 22 to a horizontal position regardless of the weight of the bumper member 42.

An eye spline at one end of a flexible member such as a rope or cord 50 is attached to be received by the hook member 38. However, instead of using the hook member 38 to receive the rope 50, a separate hook member may also be disposed near the end of the resilient rod 32. The other end of the cord 50 is attached to the support arms **16*d* and 16*c***.

When the arrangement described above is not in use, the cord 40 may be detached from the hook member 38 and the bumper member 42 may be disposed over the water between the hull of the boat and the dock to rest against the side of the dock slip 12. The cord 50 may also be removed from the hook member 38 and stored on the boat. The rod 22 may then be unscrewed from the mooring post 16 and the rod 22 may be disassembled for convenient storage by detaching the members **22*a*, 22*b*, 22*c*, etc., from their telescoping arrangement. The bar 30 may be swung upwardly from the horizontal disposition shown in FIG. 4. If desired, the bar 30 may even be removed from the rod by loosening the screws 32**.

To place in use the arrangement constituting this invention, the member **22*a* is disposed on the collar 16*d* of the mooring post 16. The rod 22 is then assembled by telescopic attachment of the members 22*a*, 22*b*, 22*c*, etc. The bar 30 is then operatively set by pivotable movement downwardly for retention by the detent members 34. The rod 22 is then pivoted in the collar 16*d* as a base so that it extends from the dock to a position over the water in the slip 12**.

Figure 1:
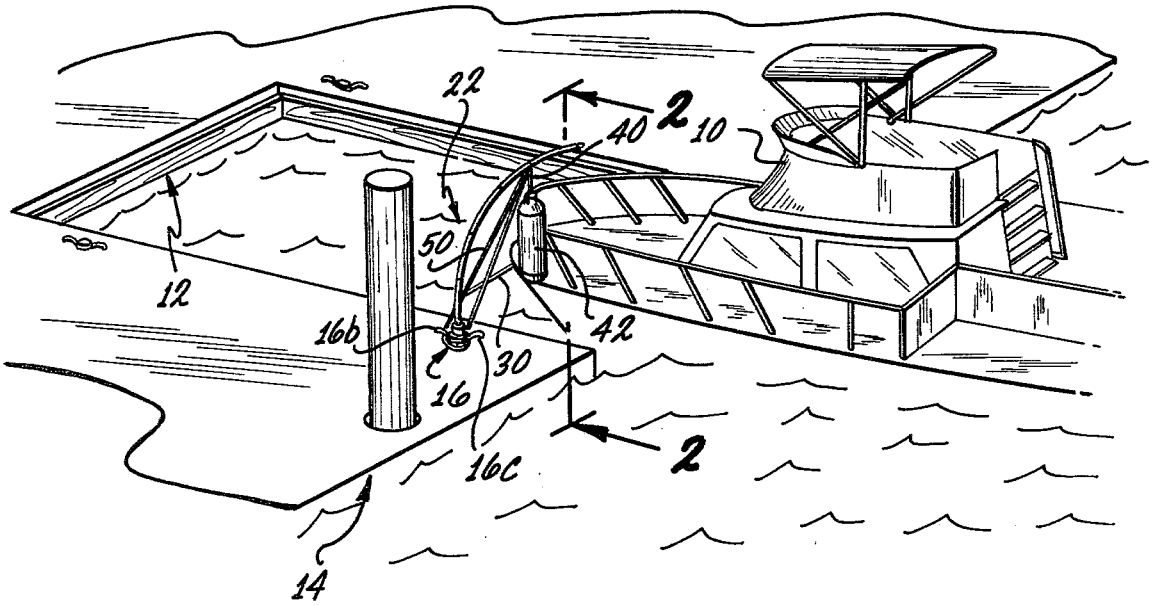
FIG. 1 is a perspective view of one embodiment of an arrangement constituting this invention for mooring a boat in a dock slip and particularly illustrates the disposition of the arrangement as the boat is entering the dock slip.
Figure 2:
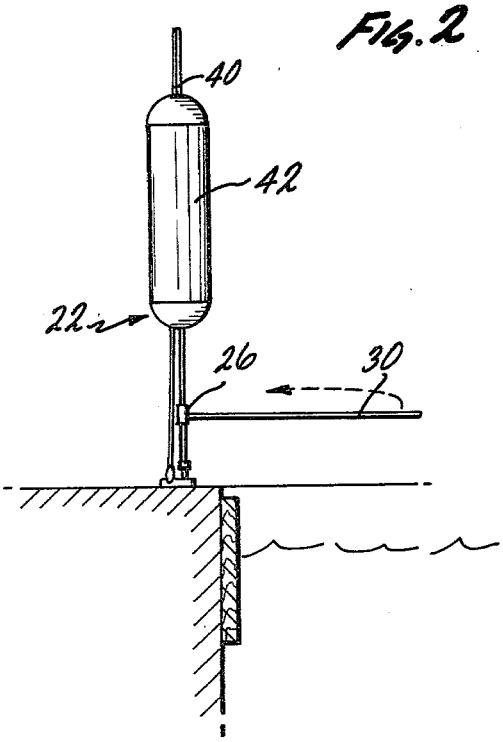
FIG. 2 is an enlarged sectional view substantially on the line 2—2 of FIG. 1 and illustrates the arrangement of this invention as the boat is entering the dock slip.

The bumper member 42 is subsequently raised from the water and the eye spline of the cord 40 is inserted on the hook member 38 as well as attached to the support arms **16*b* and 16*c*. The weight of the bumper member 42 causes the rod 22 to be bent from a vertical disposition to a bent configuration as shown in FIGS. 1 and 3. This facilitates the disposition of the eye spline of the cord 50 on the hook member 38**.

To set the arrangement in operative position, the bar 30 is pivoted downwardly from the vertical position to the horizontal position. The arrangement is then rotated through an angle of approximately 90° so that the bar 30 extends to a position over the water in the slip. This may be accomplished by the sailor as the boat leaves the dock slip.

When the apparatus is assembled and made operative as described above, the boat presses against the bar 30 as it enters the slip 12, as shown in FIG. 1. This causes the bar 30 to rotate from a position extending into the water, as shown in FIG. 1, to a position substantially parallel to the side of the dock defining one extremity of the slip 12. The rotation of the bar 30 produces a corresponding rotation of the rod 22 to a position where the rod is bent toward the boat. This causes the eye splines of the cords 40 and 50 to be easily accessible to a sailor on the boat.

The sailor then removes the eye spline of the cord 40 from the hook member and attaches the cord at an intermediate position to the boat. The sailor then disposes the bumper member 42 over the water between the hull of the boat and the dock. This bumper member is then positioned to protect the side of the boat as the boat continues into the dock slip. The sailor subsequently removes the eye spline of the cord 50 from the hook member and holds this eye spline as the boat continues into the slip. The sailor then attaches the eye spline to a hook member on the boat as the boat is moving into the slip or after the boat has completed its movement into the slip.

The removal of the eye splines on the cords 40 and 50 from the hook member 38 is facilitated by the disposition of the hook member at a position displaced from the end of the rod 22. This arrangement allows the sailor on the boat to grasp the end of the rod 22 with one hand for a steadying support and to remove the eye splines of the cords 40 and 50 from the hook member 38 with the other hand.

When the bumper member 42 has been removed from attachment to the rod and the rod 22 has been released by the sailor, no force is applied to the rod to bend the rod. This causes the resilient rod to return to an upright position. As a result, the rod is disposed entirely over the dock and can in no way affect the movement of the boat into the dock slip.

The boat is now secured to the dock and is protected from damage resulting from bumps into the side of the dock. As a result, the owner is able to alight from the boat to the dock and tighten the cord 50 by wrapping it around the support arm 16. The sailor is also able to provide other attachments between the boat and the dock to secure the boat.

The apparatus described above has certain important advantages. It is simply constructed and inexpensive. It can be easily and quickly disassembled and stored when not in use, thereby preventing a physical hazard. It can conversely be easily assembled and disposed in operative position. In placing the apparatus in the operative position, the cord attached to bumper member 42 is coupled to the rod 22 to provide a bending of the rod by the weight of the bumper member 42 so that the eye splines on the cords 40 and 50 are easily accessible to a sailor on the boat. In the operative position, the rod 22 can be pivoted to a position when the eye splines on the cords 40 and 50 are easily accessible to remove the cords from their associated hook members. In this way, the boat can be easily and quickly secured to the dock and protected from the side of the dock. Furthermore, when the cords 40 and 50 have been removed from the rod 22, the rod 22 returns to an upright position where it cannot affect the movement of the boat into the boat slip.

Instead of providing the bar 30, the rod 22 can be grasped by a hook at the end of a pole which is held by the sailor. The sailor can then exert force on the rod to pivot the rod through an angle of approximately 90° so that the rod extends over the water in the boat slip. However, the inclusion of the bar 30 is preferred since it simplifies the procedures required of the sailor on the boat.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination for use at a dock to provide for a mooring of a boat to the dock during the movement of the boat into a slip in the dock, a resilient member normally extending upwardly when in an unconstrained configuration, means for providing for a pivotal movement of the resilient member, such providing means including a member extending from the dock into the slip for engagement by the movement of the boat into the dock to provide the pivotal movement of the providing means, means including bumper means and a first cord attached at one end to the dock and at the other end to the bumper means, means provided on the resilient member at an intermediate position along the length of the resilient member for detachably retaining the bumper member and for providing a bent configuration of the resilient member with the bumper member attached to the resilient member, the first cord having properties of being adaptable in shape to provide for the disposition of the bumper means over the water between the hull of the boat and the dock when the bumper means is detached from the resilient member, a second cord having properties of being adaptable in shape and attached to the dock at a first end and being attachable to the boat at the second end, means provided on the resilient member for detachably retaining the cord at the second end of the cord, and the resilient member returning to its normally upwardly extending configuration when the first and second cords are detached.

2. The combination set forth in claim 1 wherein the resilient member is detachably supported at one end by the dock and the second cord is attached to the resilient member at a position displaced from the detachable support on the dock and the resilient member is normally positioned with the bumper member positioned over the dock.

3. The combination set forth in claim 2 wherein the resilient member is formed from a plurality of telescoping members and wherein the providing means includes a bar operatively coupled to the resilient member at a position near the bottom of the resilient member and extending from the dock over the water in the slip for engagement by the boat during the movement of the boat into the slip to pivot the resilient member when the bar is disposed over the water in the slip.

4. The combination set forth in claim 1 wherein means are attached to the dock to provide a detachable support of the resilient member and wherein means are attached to the dock to provide a support of the first and second cords.

5. In combination for use at a dock to provide for a mooring of a boat to the dock during the movement of the boat into a slip in the dock, resilient means extending upwardly in an unconstrained relationship and having properties of being deflected at a first end, in a constrained relationship, from the upward displacement, means disposed on the dock for detachably and pivotably retaining the resilient means at a second end, bumper means, first attachment means on the dock, a first cord attached at opposite ends to the bumper means and the first attachment means, engaging means coupled to the resilient means at a position near the second end of the resilient means and extending from the resilient means to a position over the water in the slip for engagement by the boat during the movement of the boat into the slip to pivot the resilient means, means operatively coupled to the resilient means for detachably securing the bumper means to provide for a detachment of the bumper means from the resilient means and a disposition of the bumper means over the water between the hull of the boat and the dock, and means detachably coupled to the resilient means for providing, upon detachment, for a mooring of the boat to the dock after movement of the boat into the slip.

6. The combination set forth in claim 5 wherein the mooring means includes:

second attachment means on the dock, a second cord attached at a first end to the second attachment means, and means on the resilient means for detachably securing the second cord at a second end to the resilient means to provide for an engagement of the second end of the cord with the boat upon a detachment of the cord from the resilient means.

7. The combination set forth in claim 5 wherein the engaging means includes a bar extending over the water in the slip and engageable by the boat to pivot the resilient means into position where the bumper means faces the boat for easy detachment from the resilient means and for disposition over the water between the hull of the boat and the dock after such detachment and the resilient means includes a plurality of numbers telescopically disposed in detachable relationship to one another.

8. The combination set forth in claim 5 wherein the bar included in the engaging means is pivotable to a horizontal disposition upon movement of the boat from the dock and is pivotable into a vertical disposition after movement of the boat into the slip.

9. The combination set forth in claim 8 wherein the resilient means includes a plurality of members telescopically disposed in detachable relationship to one another and the mooring means include;

second attachment means on the dock, a second cord attached at a first end to the second attachment means, and means on the resilient means for detachably securing the second cord at a second end to the resilient means to provide for an engagement of the second end of the cord with the boat upon a detachment of the cord from the resilient means.

10. In combination for use at a dock to provide for a mooring of a boat to the dock during the movement of the boat into a slip in the dock, resilient means, first means for providing for the attachment of the resilient means to the dock, bumper means, second means operatively coupled to the bumper means and to the attachment means for providing for a detachable connection of the bumper means to the resilient means and a disposition of the bumper means against the side of the boat between the dock and the boat upon a detachment of the bumper means from the attachment means, third means operatively coupled to the dock at one end and detachably coupled to the resilient means at the other end for attachment to the boat when detached from the resilient means, engaging means extending from the resilient means to a position over the water in the slip, engaging means operatively coupled to the resilient means and engagable to the boat for providing for a pivotable movement of the resilient means upon the engagement of the engaging means by the boat during the movement of the boat into the slip, and the engaging means include a bar extending substantially horizontally in the operative relationship from the resilient means to a position over the slip and wherein the bar is pivotable to a relationship substantially parallel to the resilient means when not in use.

11. The combination set forth in claim 10 wherein the resilient means are detachably secured to the dock and wherein the resilient means are formed from a plurality of telescoping members detachable relative to one another and wherein the second and third means include flexible cords.

12. The combination set forth in claim 10 wherein the resilient means when released from any constraint or force causes the rod to turn to an upright position, as a result the rod is disposed entirely over the dock and can in no way affect the movement of the boat into the dock slip.

13. In combination for use at a dock to provide for a mooring of a boat to the dock during the movement of the boat into a slip in the dock, resilient means extending upwardly in an unconstrained relationship and having properties of being deflected at a first end, in a constrained relationship, from the upward displacement and with a bent configuration extending over the slip, means disposed on the dock for detachably and pivotably retaining the resilient means at a second end, bumper means, first attachment means on the dock, a first cord attached at opposite ends to the bumper means and the first attachment means, means operatively coupled to the resilient means for detachably securing the bumper means to provide for a detachment of the bumper means from the resilient means and a disposition of the bumper means over the water between the hull of the boat and the dock, means detachably coupled to the resilient means for providing, upon detachment, for a mooring of the boat to the dock after movement of the boat into the slip, and the resilient means when released from any constraint returning to the upwardly extending position with the resilient means disposed over the dock and not affecting the movement of the boat into the slip.

14. In combination for use at a dock to provide for a mooring of a boat to the dock during the movement of the boat into a slip in the dock, resilient means, first means for providing for the attachment of the resilient means to the dock, bumper means, second means operatively coupled to the bumper means and to the attachment means for providing for a detachable connection of the bumper means to the resilient means and a disposition of the bumper means against the side of the boat between the dock and the boat upon a detachment of the bumper means from the attachment means, third means operatively coupled to the dock at one end and detachably coupled to the resilient means at the other end for attachment to the boat when detached from the resilient means, and the resilient means when released from any constraint or force causes the rod to turn to an upright position, as a result the rod is disposed entirely over the dock and can in no way affect the movement of the boat into the dock slip.

* * * * *